US008656567B2

(12) United States Patent
Heitmann et al.

(10) Patent No.: US 8,656,567 B2
(45) Date of Patent: Feb. 25, 2014

(54) RAPPER DEVICE

(75) Inventors: Alfons Heitmann, Gummerbach (DE); Uwe Herwig, Gummersbach (DE); Thomas Paul Von Kossak-Glowczewski, Gummersbach (DE)

(73) Assignee: Shell Oil Company, Houston, TX (US)

( * ) Notice: Subject to any disclaimer, the term of this patent is extended or adjusted under 35 U.S.C. 154(b) by 930 days.

(21) Appl. No.: 12/628,968

(22) Filed: Dec. 1, 2009

(65) Prior Publication Data

US 2010/0132142 A1 Jun. 3, 2010

Related U.S. Application Data

(60) Provisional application No. 61/120,075, filed on Dec. 5, 2008.

(30) Foreign Application Priority Data

Dec. 2, 2008 (EP) ..... 08170453

(51) Int. Cl.

| | |
|---|---|
| ***B21C 43/00*** | (2006.01) |
| ***F28G 7/00*** | (2006.01) |
| ***B08B 7/02*** | (2006.01) |
| ***B08B 9/00*** | (2006.01) |
| ***B08B 7/00*** | (2006.01) |

(52) U.S. Cl.

USPC ..... 29/81.15; 29/890.031; 29/81.01; 29/81.02; 29/81.021; 134/16; 165/84; 165/95; 15/89; 15/91; 15/92; 15/104.07; 15/246.5

(58) Field of Classification Search

USPC ..... 29/890.031, 81.01, 81.15, DIG. 53, 29/81.02, 81.021; 134/16, 8; 165/84; 15/89, 91, 92, 104.07, 246.5

See application file for complete search history.

(56) References Cited

U.S. PATENT DOCUMENTS

| | | | | | |
|---|---|---|---|---|---|
| 2,263,595 | A | * | 11/1941 | Sinkko | 29/81.16 |
| 2,777,535 | A | * | 1/1957 | Hull | 96/36 |
| 2,946,314 | A | * | 7/1960 | Nast | 173/102 |
| 2,985,802 | A | * | 5/1961 | Drenning | 96/36 |
| 3,322,172 | A | * | 5/1967 | Small | 81/19 |
| 3,477,124 | A | * | 11/1969 | Reed et al. | 29/592.1 |
| 3,626,770 | A | | 12/1971 | Lindberg | |
| 4,120,672 | A | * | 10/1978 | Lanese | 96/36 |

(Continued)

FOREIGN PATENT DOCUMENTS

| | | | |
|---|---|---|---|
| AU | 2007331421 A1 | 6/2008 | |
| DE | 3127734 | 7/1984 | 165/84 |

(Continued)

*Primary Examiner* — David Bryant
*Assistant Examiner* — Jun Yoo

(57) ABSTRACT

A rapper device for cleaning a heat exchange surface in a pressure vessel by transmitting impact energy. The rapper device includes a striker and an impacting device for impacting the striker which has one end contacting the heat exchange surface in the pressure vessel. The striker includes a piston section having a piston rod projecting out of the pressure vessel via a passage opening in line with the impacting device. A piston head is slideable within a piston chamber in line with the passage opening. The piston chamber is operatively connected to a sealing gas supply. The piston head is a separate part with an aperture. The piston rod runs through the aperture, e.g., in a slideable arrangement.

13 Claims, 2 Drawing Sheets

(56) References Cited

U.S. PATENT DOCUMENTS

| | | | | | |
|---|---|---|---|---|---|
| 4,409,007 | A | * | 10/1983 | Torrey et al. | 96/36 |
| 4,457,361 | A | * | 7/1984 | Premel et al. | 165/84 |
| 4,595,048 | A | * | 6/1986 | Pollak et al. | 165/84 |
| 5,079,459 | A | * | 1/1992 | Huston et al. | 310/15 |
| 5,597,417 | A | | 1/1997 | Thones et al. | 134/1 |
| 5,765,510 | A | * | 6/1998 | Krowech et al. | 122/379 |
| 8,291,560 | B2 | * | 10/2012 | Peippo | 29/81.15 |

FOREIGN PATENT DOCUMENTS

| | | | |
|---|---|---|---|
| GB | 2104614 | 3/1983 | B08B 9/00 |
| GB | 2147078 | 5/1985 | B25D 1/00 |
| JP | 2002220593 | 8/2002 | F28G 7/00 |

* cited by examiner

RAPPER DEVICE

This application claims the benefit of European Application No. 08170453.8 filed Dec. 2, 2008 and U.S. Provisional Application No. 61/120,075 filed Dec. 5, 2008, both of which are incorporated by reference.

BACKGROUND OF THE INVENTION

The present invention relates to a rapper device for cleaning heat exchange surfaces in a pressure vessel for transporting hot dust-laden gas.

Hot process gases can contain fouling components, such as fine dust and molten or evaporated components, which turn sticky when they cool and condense, thereby adhering to each other and to surfaces in contact with the gases. These fouling components can form harmful deposits, particularly on heat exchange surfaces.

Such hot process gases can for example be synthetic gases synthesized by partial combustion processes, generally referred to as syngas. These gases are guided along heat exchanging surfaces in a pressure vessel.

Fouling deposits from hot dust laden process gases can be removed by using a rapper device, such as the rapper device disclosed in British patent application GB 2 104 614 A. This prior art rapper device comprises an energy transmitting element or striker having one end within a pressure vessel contacting the heat exchange surface to be cleaned, and one end outside the pressure vessel, which is repetitively knocked by an impact device. The impact energy of the knocking device is passed through the energy transmitting element to the heat exchange surface. The heat exchange surface and the deposits adhering thereto are accelerated differently by the transmitted impact energy as a result of different mass moments of inertia. As a result, the deposits fall off the heating surface.

The pressure within the pressure vessel is much higher than the atmospheric environmental pressure outside the pressure vessel. For example, in coal pressure gasification plants the pressure in the heat exchange vessel can be as high as about 40 bar. Due to these differences in pressure, the energy transmitting element or striker is forced towards the outside of the pressure vessel. In GB 2 104 614 A, a gas pressure equalizing device is used to overcome this force. Since the pressure on the one end of the striker should be equal to the pressure exerted on the end abutting the heat exchange surface, the surface area of the energy transmitting element within the pressure chamber should be sufficiently high. Since in GB 2 104 614 A the wall of the pressure vessel is interrupted where it is passed by the striker, a number of seals must be used to prevent leakage of synthetic gas, which is toxic and inflammable. These seals typically have short life cycles.

The striker is subjected to repetitive impact loads. This results in the formation of cracks after a number of operation cycles, particularly at locations of abrupt diameter changes. This limits the technical life time of the device.

SUMMARY OF THE INVENTION

The invention provides a rapping device with a striker having a high impact resistance and increased life time. This is achieved with a rapper device for cleaning a heat exchange surface in a pressure vessel by transmitting impact energy, the rapper device comprising a striker and an impacting device for impacting the striker which has one end contacting the heat exchange surface in the pressure vessel, wherein the striker comprises a piston section comprising a piston rod projecting out of the pressure vessel via a passage opening in line with the impacting device, and a piston head slideable within a piston chamber in line with the passage opening, the piston chamber being operatively connected to a sealing gas supply, wherein the piston head is a separate part with an aperture, wherein the piston rod runs through the aperture.

BRIEF DESCRIPTION OF THE DRAWINGS

The present invention will be elucidated with reference to the drawings wherein.

DETAILED DESCRIPTION OF THE INVENTION

Since the piston head is separate from the piston rod cracks cannot occur anymore at locations of abrupt diameter changes.

The piston head can be slideable relative to the piston rod. The piston head can for example be coaxial with the piston rod. The piston rod can be provided with a stop, e.g., a terminal flange to limit the freedom of movement of the piston head relative to the piston rod. In use, the piston head is pressed against the terminal flange by pressure of the sealing gas, and optionally by additional pressure exerted by a compression spring, or the like.

The striker can for instance comprise a rod or ram within the pressure vessel with one end abutting the piston rod and one end abutting the heat exchange surface. The diameter of the rod can for example be larger than the diameter of the piston rod. The rod can for example be made of a softer material than the piston rod since it is easier to replace.

Optionally, the outer end of the striker contacting the heat exchange surface can be provided with a head of enlarged diameter. The head can be made of a material which is softer than the material of the other parts of the striker. To provide an interchangeable connection, the head can for example be connected to the outer end of the striker by means of a screw thread.

In a specific embodiment, the striker is supported by a support member in the pressure vessel with one end connected to a wall section around the passage opening. The support member can for example be cylindrical and have openings so that its interior is in open connection with the interior of the pressure vessel.

The pressure in the piston chamber can for example be maintained at about at least 10% higher than the pressure in the pressure vessel. While the temperature in the pressure vessel is typically about 40 bar, the pressure in the piston chamber can for example be kept about 6-7 bar higher.

Suitable sealing gases are for instance inert gases, such as nitrogen or carbon dioxide.

Figure 1:
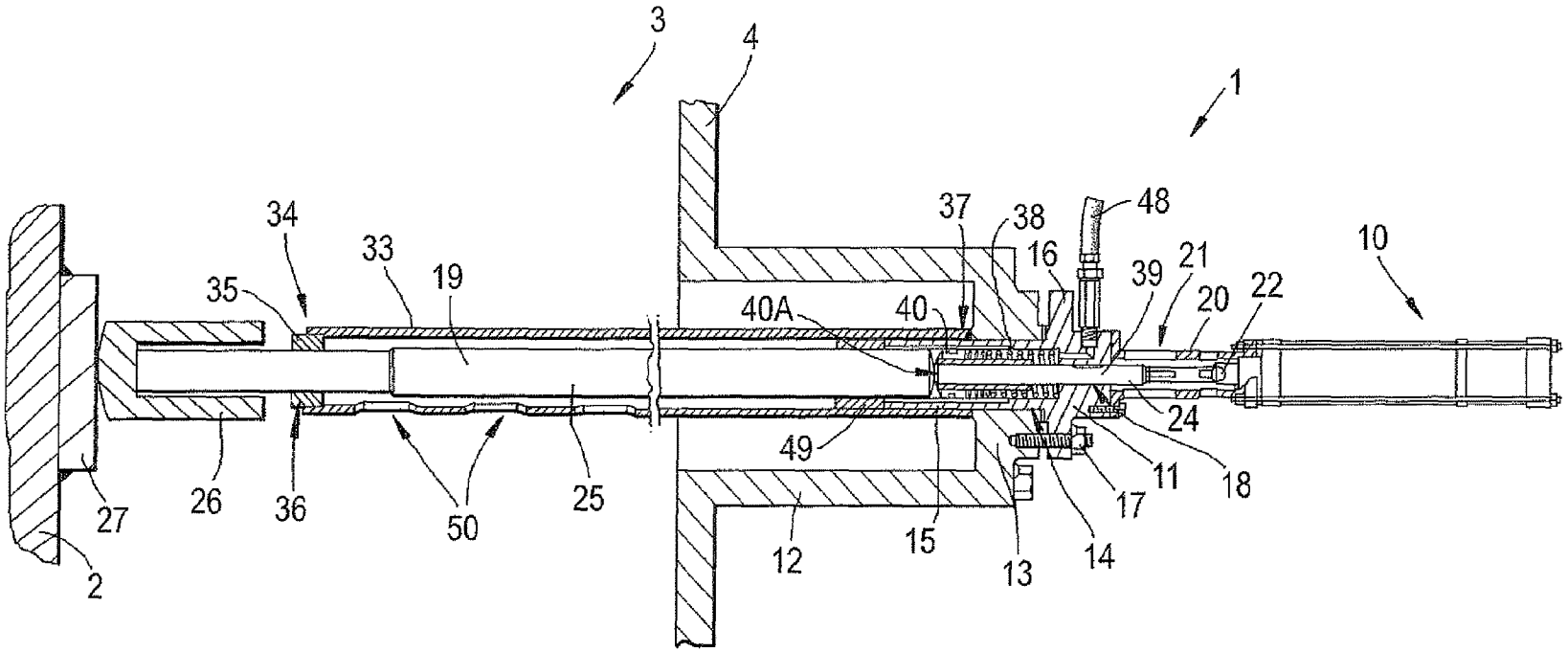
FIG. 1: shows in cross section a rapper device according to the present invention.

FIG. 1 shows in cross section a rapper device 1 for cleaning a heat exchange surface 2 in a pressure vessel 3 with a pressure vessel wall 4. In the pressure vessel 3, synthetic gas, synthesized, e.g., by partial combustion of oil or coal, is guided along the heat exchange surface 2, e.g., of a heat exchange pipe, which is cooled by a flowing cooling medium, such as water.

The rapper device 1 comprises an impact device 10 attached to a housing 11 on the wall of the pressure vessel 3. The housing 11 comprises a first cylindrical body 12 branching off from the pressure vessel wall 4. The cylindrical body 12 comprises an outer end closed off by an end wall 13 with a central passage opening 14. A cylindrical bus 15 is fit into the passage opening 14 and comprises a flange 16 abutting the exterior surface of the end wall 13. Flange 16 is connected to end wall 13 by an array of bolts 17 and comprises a central passage opening 18.

In line with the passage opening 18 is a spacer 20 with openings 21. The spacer 20 can for instance be cylindrical. The spacer 20 carries the impact device 10 having a knocker head 22 in line with the passage opening 18.

The rapper device 1 further comprises a striker 19 with a piston section 24 slideable within the bus 15. The striker 19 also comprises a second section 25 being a rod of a larger diameter. The second section 25 of the striker rod 19 is positioned within the pressure vessel 3 and has one end slideably fitting into bus 15. The piston section 24 is separate from the second section 25. One end of the piston section 24 is provided with a piston rod 39 and a piston head 40. The piston head 40 is arranged on the end of the piston rod 39, where the piston rod 39 runs slideably through a central aperture 40A in the piston head 40. The piston rod 39 abuts rod section 25 of the striker rod 19. The piston rod 39 is provided with a terminal flange 39A forming a stop which limits the freedom of movement of the piston head 40 relative to the piston rod 39. The piston head 40 is pressed against the flange 39A by the pressurized sealing gas and additionally by a compression spring 44. The other end of the piston section 24 passes through the passage opening 18 to be within the scope of knocker head 22.

The second section 25 of the striker rod 19 extends in the direction of the heat exchange surface 2. Near the heat exchange surface 2, the striker rod 19 is provided with a head 26 of an enlarged diameter. The head 26 can for example be connected to the second section 25 of the strike rod 19 by means of a screw thread connection. The head 26 abuts an anvil plate 27 welded onto the heat exchange surface 2. Due to the enlarged diameter of the head 26, the contact surface between the head 26 and the anvil plate 27 is enlarged. The head 26 is made of a material of lower hardness than the material used for section 25 and anvil plate 27. As a result, the replaceable head 26 will deform more than the other parts during operation of the rapper device 1. After a certain period of use, the deformed head 26 can be exchanged for a new head 26.

A cylindrical support member 33 within the pressure vessel 3 encases the striker rod 19 in a coaxial arrangement. The cylindrical support member 33 has a first end 34 closed with an end wall 35 with a central opening 36 for the striker rod 19 which is slideably supported within the central opening 36. The opposite second end 37 of the cylindrical support member 33 is slid over the bus 15 with a tight fit and gastight connected to the inside of end wall 13.

Figure 2:
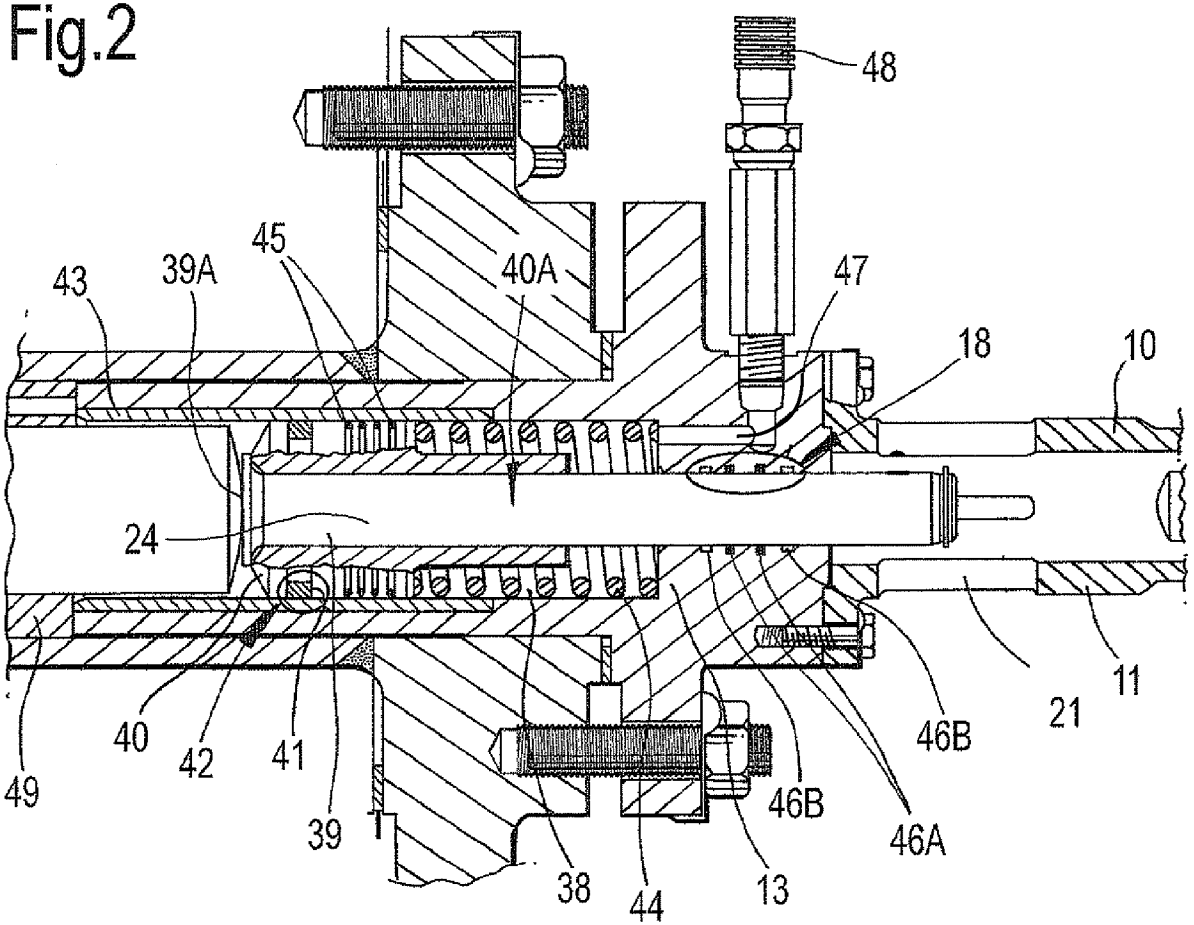
FIG. 2: shows in a more detailed cross section the piston chamber of the rapper device of FIG. 1.

Between the piston rod of piston section 24 and the inner wall of bus 15 a cylindrical space 38 is formed. This is shown in more detail in FIG. 2. The piston head 40 delimits one end of the cylindrical space 38. The other end of the cylindrical space 38 is demarcated by the inner side of end wall 13. A sealing ring 41 is present in a coaxial recess 42 in the piston head 40. The sealing ring 41 seals against the interior of a cylindrical bus 43 covering part of the interior side of cylindrical bus 15.

Within the cylindrical space 38 between the piston head 40 and the inner side of end wall 13 is the compression spring 44 spacing the piston head 40 from the end wall 13. The piston head 40 is further provided with four smaller sealing rings 45. The first striker rod section 24 is also sealed against the interior wall of passage opening 18 with two guiding rings 46A—e.g., rings of PTFE or a similar material—between two sealing rings 46B.

Outside the pressure vessel 3, the bus 15 is provided with a sealing gas supply channel 47 leading from a sealing gas supply 48 to the cylindrical space 38 which forms a piston chamber with a pressure built up by the sealing gas supplied via channel 47.

The second section 25 of striker rod 19 is sleeved by a cylindrical filter 49 abutting the outer end of cylindrical bus 15. The filter 49 prevents migration of dust from the pressure vessel 3 into the area of the piston section 24.

As shown in FIG. 1, the support member 33 is provided with openings 50 providing an open connection for the inner space of the support member 33 with the rest of the pressure vessel 3.

In use, hot dust laden gas, e.g., syngas from a gasification reactor, passes through the space between the heat exchange surface 2 and the pressure vessel wall 4. Fouling deposits are formed on the surface of the heat exchange wall 2. To clean this wall 2, the impact device 10 is actuated to knock with its knocker head 22 with a certain impact force onto the piston section 24 of the striker rod 19. The piston section 24 of the striker rod 19 passes the impact via the rod section 25 and its enlarged head 26 to the anvil plate 27 on heat exchange wall 2. The impact load loosens the fouling which falls off of the wall 2.

Due to the impact forces, the striker rod section 25 will become shorter after long time operation. The total length of the striker 19 can be monitored via the openings 21. If the piston section 24 is not visible anymore via these openings 21, the rod 25, which is made of a softer material than the piston section 24, needs to be replaced. Optionally, the opening 21 can be provided with a scale to monitor progress of the size reduction of striker rod 19 in detail.

To prevent leakage of hot, inflammable and toxic syngas through the passage opening 18, an inert sealing gas is blown into the piston chamber 38. The pressure within the pressure vessel 3 is substantially higher than atmospheric. As a result, a force is exerted on the striker rod 19 to push it out of the pressure vessel 3 via the passage opening 18. Since the pressure within the pressure vessel can be as high as, for instance, 40 bar, the launching force on the sections 24, 25 of striker rod 19 can be very high. To overcome this force, the sealing gas is supplied to the piston chamber 38 under overpressure, to produce a counterforce on the striker rod 19 via the piston head 40. The overpressure can be such that the head 26 of the rod section 25 of striker rod 19 is firmly pressed against the anvil plate 27 of the heat exchange wall 2. The pressure in the piston chamber 38 can, e.g., be about 6-7 bar higher than the pressure of about 40 bar in the pressure vessel 3.

What is claimed is:

1. A rapper device for cleaning a heat exchange surface in a pressure vessel by transmitting impact energy, the rapper device comprising:

an impacting device for impacting a striker; and the striker;

wherein the striker comprises an outer end contacting the heat exchange surface in the pressure vessel, and a piston section comprising a piston rod projecting out of the pressure vessel via a passage opening in line with the impacting device, and a piston head slideable within a piston chamber in line with the passage opening, the piston chamber being operatively connected to a sealing gas supply, wherein the piston head is a separate part from the piston rod, wherein the piston head has an aperture, and wherein the piston rod runs through the aperture.

2. A rapper device according to claim 1 wherein the piston head is slideable relative to the piston rod.

3. A rapper device according to claim 2 wherein the piston rod and the piston head are coaxial.

4. A rapper device according to claim 1 wherein the piston rod is provided with a terminal flange to limit the freedom of movement of the piston head relative to the piston rod.

5. A rapper device according to claim 1 wherein the striker further comprises a rod with one end abutting the piston rod and one end abutting the heat exchange surface in the pressure vessel.

6. A rapper device according claim 1 wherein the outer end of the striker contacting the heat exchange surface is provided with a head of enlarged diameter.

7. A rapper device according to claim 6 wherein the head is made of a material which is softer than the material of other parts of the striker.

8. A rapper device according to claim 6 wherein the head is connected to the outer end of the striker by means of a screw thread.

9. A rapper device according to claim 1 wherein the striker is supported by a support member with one end connected to a wall section around the passage opening.

10. A rapper device according to claim 1 wherein the impacting device comprises a knocker head.

11. A rapper device according to claim 10 wherein the knocker head is configured to impact force to the piston section.

12. A rapper device according to claim 10 wherein the knocker head lies outside of the piston chamber.

13. A rapper device according to claim 1, further comprising a spring in the piston chamber.

* * * * *